US011460269B2

(12) United States Patent
Cochran

(10) Patent No.: US 11,460,269 B2
(45) Date of Patent: Oct. 4, 2022

(54) HANDGUN HOLSTER WITH TRIGGER GUARD

(71) Applicant: Apricot Ideas, Inc., Walpole, MA (US)

(72) Inventor: Joseph Cochran, Holly Ridge, NC (US)

(73) Assignee: Apricot Ideas, Inc., Walpole, MA (US)

( * ) Notice: Subject to any disclaimer, the term of this patent is extended or adjusted under 35 U.S.C. 154(b) by 137 days.

(21) Appl. No.: 16/883,334

(22) Filed: May 26, 2020

(65) Prior Publication Data

US 2020/0370864 A1 Nov. 26, 2020

Related U.S. Application Data

(60) Provisional application No. 62/851,739, filed on May 23, 2019.

(51) Int. Cl.
*F41C 33/04* (2006.01)
*F41A 17/54* (2006.01)

(52) U.S. Cl.
CPC ..... *F41C 33/048* (2013.01); *F41A 17/54* (2013.01)

(58) Field of Classification Search
CPC ..... A45F 2200/0591
See application file for complete search history.

(56) References Cited

U.S. PATENT DOCUMENTS 5,894,976 A * 4/1999 Harper ..... F41C 33/0227 224/587
9,513,084 B1 * 12/2016 Baugh ..... F41C 33/048
2014/0158734 A1 * 6/2014 Bickert ..... F41C 33/048 224/587
2015/0233670 A1 8/2015 Galoob
2015/0366280 A1 12/2015 Fay
2016/0265875 A1 9/2016 Malcolm
2020/0068968 A1 * 3/2020 Robinson ..... F41C 33/0209

OTHER PUBLICATIONS

International Search Report and Written Opinion issued for PCT/US20/34534, dated Jul. 24, 2020, 11 pp.

* cited by examiner

*Primary Examiner* — Corey N Skurdal
(74) *Attorney, Agent, or Firm* — Brooks Kushman P.C.

(57) ABSTRACT

Handgun holster devices are provided that allow a user to securely, comfortably and safely carry a handgun on their person. The holster may be integral with a support band configured to be worn on a body part of a user. The holster and support band may each be made from one or more flexible materials such that the device is lightweight, unobtrusive and comfortable to carry in a concealed manner. The holster includes a trigger guard that is sized, shaped and positioned to substantially cover the trigger of a holstered handgun, thereby preventing a user from inadvertently discharging the weapon.

20 Claims, 7 Drawing Sheets

HANDGUN HOLSTER WITH TRIGGER GUARD

CROSS-REFERENCE TO RELATED APPLICATIONS

The present application claims the benefit of U.S. provisional patent application Ser. No. 62/851,739, titled "Hard Trigger Guard On Soft Pistol Holster," filed May 23, 2019, which is incorporated by reference herein in its entirety.

BACKGROUND

This specification relates generally to holsters for securely carrying a handgun. More particularly, this specification relates to flexible handgun holsters having safety features that prevent inadvertent discharge of a holstered firearm.

Handgun owners often employ a holster to securely carry their handguns in a concealed manner. Indeed, a wide variety of holsters have been developed to accommodate concealed carry of a handgun at various locations on a user's body (e.g., a chest, waist, arm, shoulder, or ankle). For example, one popular type of concealable handgun holster is configured to be worn inside the waistband ("IWB") of a garment, such as pants or a skirt, and against a user's body.

Conventional concealed carry holsters are made from rigid materials, such as metals, stiffened leather, and thermoformable plastics (e.g., KYDEX). Although these holsters may provide secure handgun storage, many users find rigid holsters to be bulky, heavy and uncomfortable—especially when worn inside a waistband.

Handgun holsters made of soft, flexible materials (e.g., elastic, neoprene, nylon, etc.) have become increasingly popular with gun owners wishing to carry their firearm in a concealed manner. Flexible holsters are generally thinner and lighter than their rigid counterparts, and many users find them to be significantly more comfortable to carry for extended periods of time or when participating in athletic activities (e.g., walking, jogging, bike riding, etc.). Unfortunately, these handgun holsters do not provide the same level of safety as conventional, rigid holsters. Indeed, the soft, flexible materials employed in these holsters do not prevent a user from inadvertently actuating the trigger of a holstered firearm, which may be catastrophic.

Accordingly, there is a need for a handgun holster that allows a user to securely, comfortably and safely carry a handgun on their person. It would be beneficial if the handgun holster was made from a soft, flexible material. And it would be further beneficial if the holster included a trigger guard feature adapted to prevent the trigger of a holstered handgun from being actuated.

SUMMARY

In accordance with the foregoing objectives and others, exemplary handgun holster devices are disclosed herein that allow a user to securely, comfortably and safely carry a handgun on their person. The disclosed embodiments include a holster adapted to receive and securely retain a handgun therein. The holster may optionally be integral with, or otherwise attachable to, a support band configured to be worn on a body part of a user, such as a waist, chest, arm, shoulder or ankle. The holster and support band may each be made from one or more soft, flexible materials such that the device is lightweight, unobtrusive and comfortable to carry.

The handgun holster device includes a trigger guard adapted to prevent a user from inadvertently discharging a handgun seated within the holster. The trigger guard may include a thin, rigid guard plate disposed within a cover attached to a front surface of the holster, at a location aligned with the trigger of a holstered handgun. The trigger guard may be sized and shaped to substantially cover the handgun trigger, thereby preventing actuation of the trigger when the gun is secured in the holster.

In some embodiments, the handgun holster device may include a securing strap that allows a user to open and close a top aperture of the holster. A handgun may be inserted into, or removed from, the holster via the top aperture, when the securing strap is in an open configuration. And the handgun may be prevented from exiting the holster when the securing strap is in a closed position. Generally, the securing strap may have a first end that is fixed to the holster and a second end that is removably fastenable to the holster. Accordingly, the securing strap may be wrapped around the grip portion of a holstered handgun and the second end may be removably fastened to the holster to prevent the handgun from exiting the holster via the top aperture.

In one embodiment, a handgun holster device is provided. The device may include a holster having a front panel joined to a rear panel to define an interior compartment, which may generally be configured to receive a handgun. The front panel and the rear panel may each be made of a flexible material, such as elastic, neoprene, suede leather, cotton, polyester, rubber, nylon and/or combinations thereof. The holster may include closed left and right sides and parallel top and bottom surfaces extending between the closed left and right sides. The top surface may include a top aperture in communication with the interior compartment and configured to allow the handgun to be inserted into, and removed from, the interior compartment. The bottom surface may include a bottom aperture in communication with the interior compartment and configured to allow a barrel of the handgun to extend out of the interior compartment. The holster may further include a trigger guard configured to prevent a trigger of the handgun from being actuated. Generally, the trigger guard may include a cover attached to a front surface of the front panel and a guard plate disposed within the cover.

In some cases, the front panel of the holster is joined to the rear panel via stitching or an adhesive. The cover of the trigger guard may similarly be attached to the front surface of the front panel via stitching or an adhesive.

The handgun holster device may also include a securing strap configured to allow a user to open the top aperture to insert or remove the handgun from the interior compartment and close the top aperture to prevent the handgun from exiting the interior compartment. In such cases, the securing strap may include a first end attached to a rear surface of the rear panel and a second end having a fastener. The second end may be attached to a complementary fastener located on the cover of the trigger guard. Alternatively, the second end may be attached to a complementary fastener located on a front surface of the front panel (i.e., within the interior compartment).

In certain cases, the holster may include a central wall formed by joining the front panel to the rear panel. The central wall may extend into the interior compartment such that it may contact a trigger protector portion of a holstered handgun to thereby prevent further downward movement of the handgun. In one exemplary case, the central wall may extend vertically between a bottom located at the bottom surface of the holster to a top located within the interior compartment. In such case, the central wall may define a left side of the bottom aperture of the holster. That is, the bottom aperture may extend along the bottom surface, from the bottom of the central wall to about the closed right side of the holster. In cases where a central wall is present, the trigger guard may extend along the front surface of the front panel, above the central wall.

The handgun holster device may also include a support band adapted to support the holster and to be worn on a body part of a user (e.g., a waist). In some cases, the support band is integral with the holster such that the rear surface of the holster is formed by a front surface of the support band. In one such case, the support band may be made of a neoprene material and the front panel of the holster may be made of an elastic material. Alternatively, a rear surface of the rear panel of the holster may include an attachment means for removably attaching the holster to the support band or a garment.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

FIG. 1A shows a front panel 113 of the holster 110 covering at least a portion of the handgun 150. FIG. 1B shows the covered portion of the handgun 150 in broken lines, wherein the trigger 152 is covered by a trigger guard 120 located on the front panel 113 of the holster 110.

DETAILED DESCRIPTION

Various handgun holster devices are disclosed herein that allow a user to securely, comfortably and safely carry a handgun on their person. The disclosed embodiments comprise a holster adapted to receive and retain a handgun therein. The holster may optionally be integral with, or otherwise attachable to, a support band configured to be worn on a body part of a user, such as a waist, chest, arm, shoulder or ankle. The holster and support band may each be made from one or more flexible materials such that the device is lightweight, unobtrusive and comfortable to carry in a concealed manner (e.g., IWB).

Unlike conventional flexible holsters, the disclosed embodiments comprise a trigger guard that prevents a user from inadvertently discharging a holstered handgun. The trigger guard may include a rigid guard plate disposed within a cover that is attached to a front surface of the holster. The trigger guard may be sized, shaped and positioned to substantially cover the trigger of a holstered handgun, thereby preventing actuation of the trigger.

The disclosed embodiments are generally adapted to allow a user to safely and securely carry nearly any sized handgun. For example, the embodiments may be configured to carry full-size, mid-size, compact, and/or subcompact handguns. As used herein, the term "handgun" is meant to include any firearm that can be held and fired with one hand, such as a pistol or a revolver.

Figure 1A:
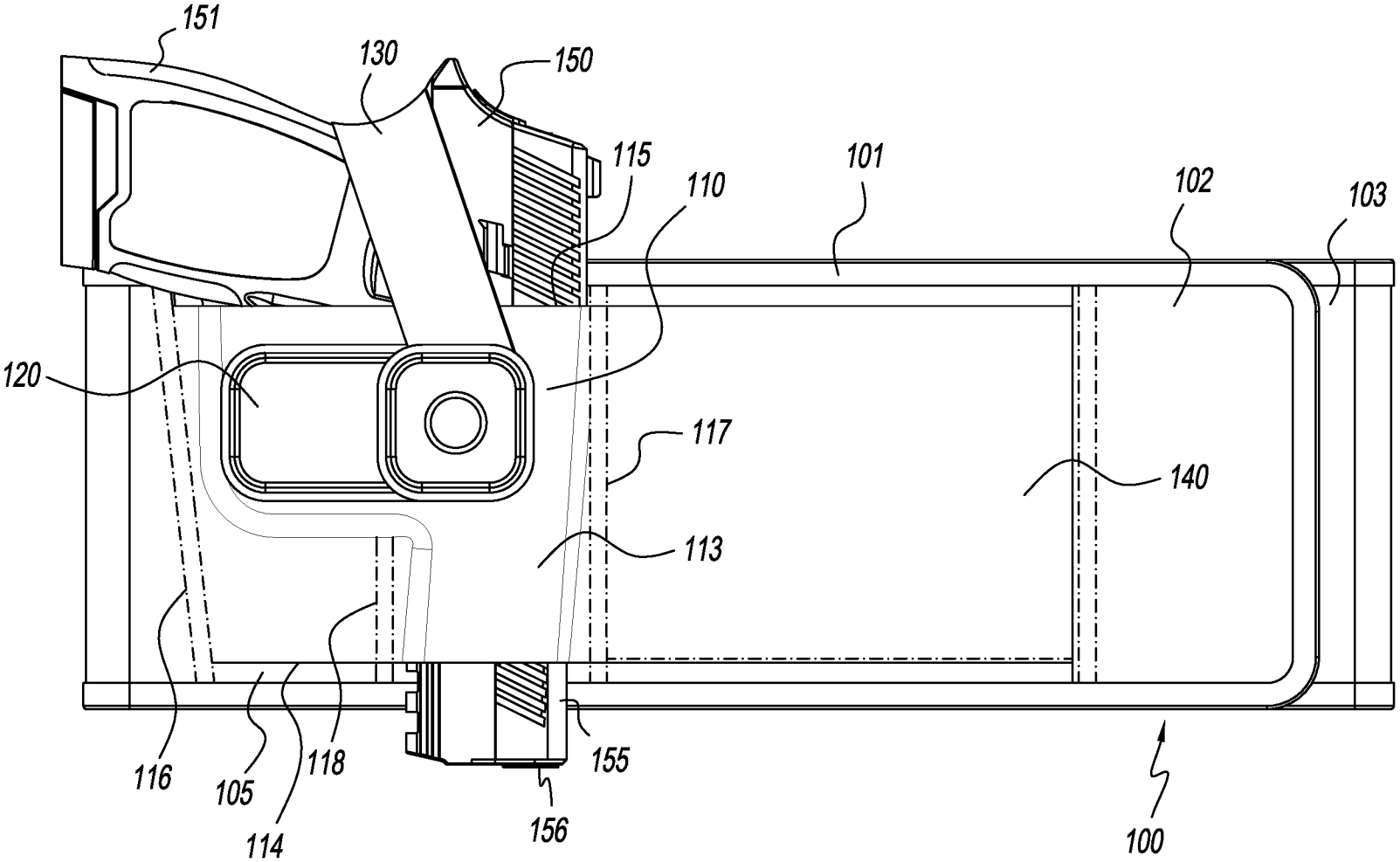
FIGS. 1A-1B show an exemplary handgun holster device 100 securely retaining a handgun 150 within a holster 110 thereof.
Figure 1B:
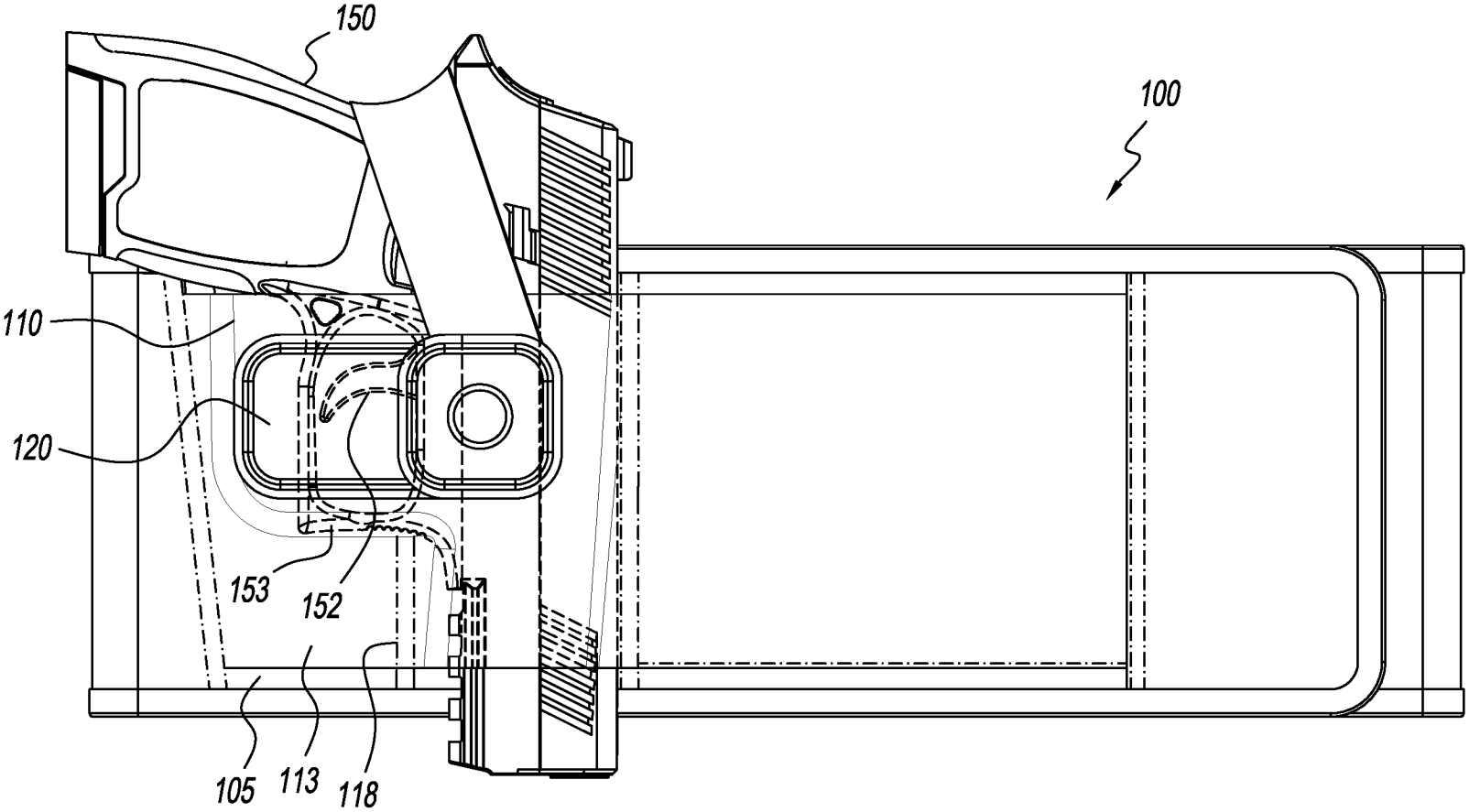
Figure 2:
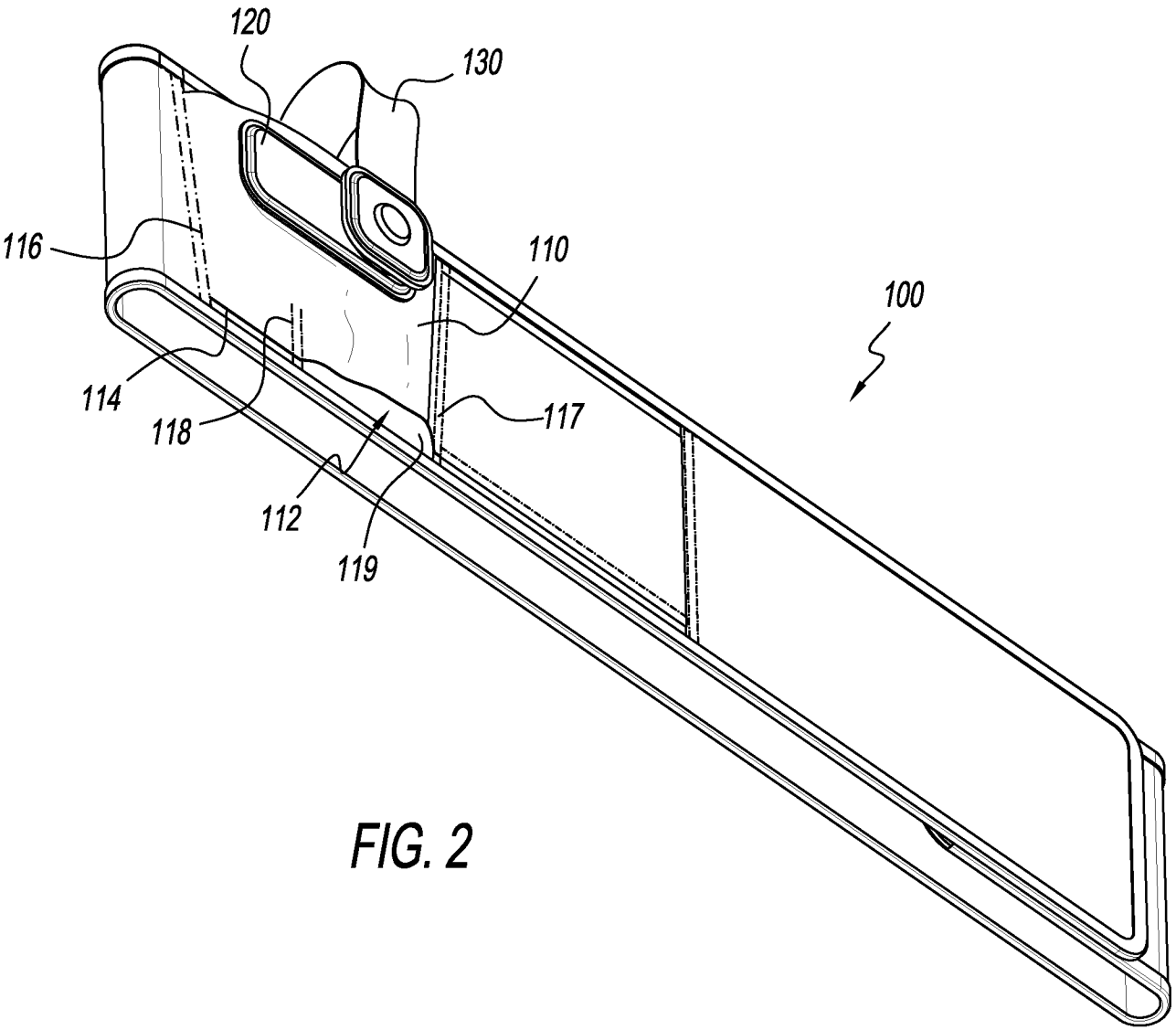
FIG. 2 shows a bottom perspective view of the exemplary handgun holster device 100 without a handgun disposed in the holster 110 such that a bottom aperture 112 and internal compartment 119 of the holster 110 are visible.
Figure 3:
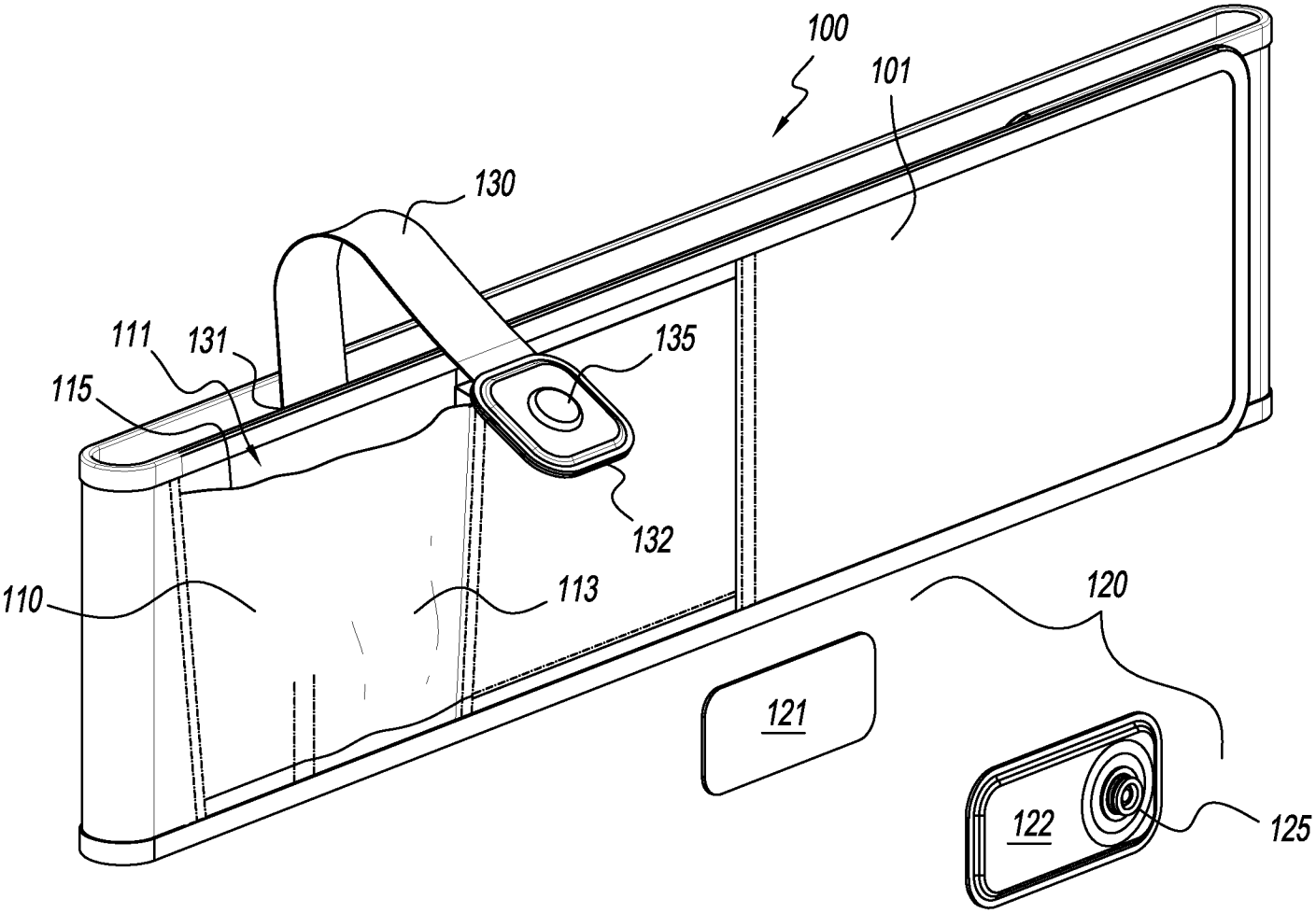
FIG. 3 shows an exploded view of the exemplary handgun holster device 100 wherein a guard plate 121 and a cover 122 of the trigger guard 120 are visible.

Referring to FIGS. 1A-3, an exemplary handgun holster device 100 is illustrated in various configurations. FIGS. 1A-1B show front views of the handgun holster device 100 securely holstering a gun 150 in a holster 110 thereof. FIG. 2 shows a bottom perspective view of the handgun holster device 100, wherein the handgun has been removed from the holster 110 and both an interior compartment 119 and bottom aperture 112 of the holster are exposed. And FIG. 3 shows an exploded view of the trigger guard 120 of the handgun holster device 100.

As shown, the handgun holster device 100 comprises a holster 110 adapted to receive and securely retain a handgun. The holster 110 generally defines an interior compartment 119 that is sized and shaped to follow the contours of a handgun 150.

The holster 110 may comprise a single piece of material or may comprise a plurality of panels of material(s) joined together to define the internal compartment 119. Such panels may generally comprise a soft, flexible material, such as but not limited to: elastic, neoprene, suede leather, cotton, polyester, rubber, nylon and/or combinations thereof. In one embodiment, the holster comprises a front panel 113 made of a woven elastic material and a rear panel 105 made of a neoprene material.

In certain embodiments, a surface of the internal compartment 119 may comprise an additional material that enhances friction between the compartment and a handgun 150 therein. For example, a rear surface of the front panel 113 and/or a front surface of the rear panel 105 may have an additional material joined thereto via stitching or an adhesive. In one such embodiment, one or both of the panels 105, 113 may be lined with a microfiber textile such as polyesters and/or polyamides.

In one embodiment, the holster 110 comprises a front panel 113 joined to a rear panel 105 (e.g., via stitching, bonding, an adhesive or the like) to form closed left 116 and right 117 sides extending between parallel top 115 and bottom 114 surfaces. As shown, the right side 117 of the holster 110 may be substantially perpendicular to the top 115 and bottom 114 surfaces, while the left side 116 of the holster may extend inward at an angle from the top surface to the bottom surface. Accordingly, the right side 117 may define a width of the holster (i.e., a distance from the top surface 115 to the bottom surface 114), which may be from about 3.75 inches to about 4.25 inches (e.g., about 4 inches).

In one embodiment, the holster 110 comprises a substantially open top surface 115 extending from the closed right side 117 to the closed left side 116. The top surface 115 comprises a top aperture 111 sized such that a handgun may be inserted into and/or removed from the interior compartment 119 of the holster 110 via the aperture. Accordingly, the top aperture 111 may extend substantially throughout the entire length of the top surface 115 or may be made shorter, as desired or required. In one embodiment, the top aperture 111 extends throughout the entire length of the top surface 115 to define a length of the holster (i.e., a distance from the left side 116 to the right side 117), which may be from about 3.75 inches to about 4.25 inches (e.g., about 4 inches).

The holster further comprises a bottom surface 114 that extends parallel to the top surface 115, from the right side 117 to the left side 116 of the holster. Because the left side 116 extends slightly inward from the top surface 115 and the right side 117 is perpendicular to the top surface, the bottom surface 114 may be slightly shorter than the top surface. For example, when the top surface 115 comprises a length of about 4 inches, the bottom surface may extend a length of from about 2.75 inches to about 3.25 inches (e.g., about 3 inches).

Generally, the bottom surface 114 comprises a bottom aperture 112 configured to allow a muzzle 156 and portion of a barrel 155 of a handgun 150 to extend therethrough. In one embodiment, the bottom aperture 112 may extend substantially throughout the entire length of the bottom surface 114. In another embodiment, the bottom aperture 112 may extend from about the right side 117 to a central wall 118 that extends perpendicularly through the bottom surface 114 (discussed below). In such cases, the bottom aperture may comprise a length of from about 1.5 inches to about 2.5 inches (e.g. about 2 inches).

As best shown in FIG. 1B, the holster 110 may comprise a central wall 118 configured to contact a trigger protector portion 153 of a handgun 150 disposed within the interior compartment 119 of the holster 110. When the handgun 150 is inserted into the interior compartment 119 through the top aperture 111, the gun may be pushed downward until the trigger protector portion 153 contacts the central wall 118 and/or the grip portion 151 contacts the top surface 115 of the holster. Accordingly, the central wall 118 may prevent a handgun 150 from moving below a certain position within the interior compartment 119.

In one embodiment, the central wall 118 may be formed by joining the front panel 113 to the rear panel 105 (e.g., via stitching or the like), along a width of the holster. For example, the central wall 118 may extend upwards (i.e., towards the top surface 115) from a position on the bottom surface 114 that is about 1.5 inches to about 2.5 inches (e.g. about 2 inches) from the right side. In such cases, the central wall 118 may extend about 1 inch upwards into the interior compartment 119.

It will be appreciated that the central wall 118 may alternatively or additionally be formed along a length of the holster 110. For example, the central wall 118 may extend inwards (towards the right side 117) from a position on the left side 116 that is about 1 inch above the bottom surface 114. In such cases, the central wall 118 may extend about 1 inch inwards into the interior compartment 119.

In any event, the specific dimensions, structures and materials employed allow the holster 110 to securely retain at least a portion of a handgun 150 within an interior compartment 119 thereof. For example, as shown in FIG. 1B, the front panel 113 of the holster 110 may cover at least a trigger 152 and a portion of a barrel 155 of the handgun 150. It will be appreciated that, in some cases, a portion of a grip 151 of a handgun 150 may remain outside the interior compartment 119 when the handgun is seated within the holster. That is, a portion of the grip 151 may extend out of the top aperture 111 and to the left thereof.

Trigger Guard

Importantly, the holster 110 comprises a trigger guard 120 configured to prevent the trigger 152 of a holstered handgun 150 from being actuated. As best shown in FIG. 1B, the trigger guard 120 is positioned such that it substantially covers the trigger 152 of a handgun 150 disposed within the internal compartment 119 of the holster 110. In one embodiment, the trigger guard extends along a length of the front panel 113 of the holster 110, from slightly right of the left side 116 to slightly left of the right side 117. The trigger guard also extends along a width of the front panel 113 of the holster 110, from slightly below the top surface 115 to slightly above the central wall 118.

In one embodiment, the trigger guard 120 comprises a guard plate 121 disposed within a guard plate cover 122 that is attached to the front panel 113 of the holster 110 via an attachment means, such as stitching or an adhesive. The guard plate 121 generally comprises a thin sheet of a rigid material capable of shielding a handgun trigger 152 and preventing access to the same while the gun is disposed within the holster 110. Accordingly, the guard plate 121 may comprise a strong, rigid material such as plastic or metal.

Figure 4A:
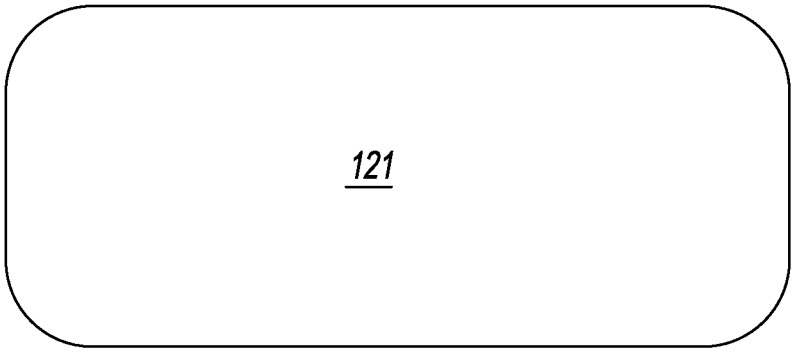
FIGS. 4A-4B show front and perspective views of the guard plate 121 employed in the trigger guard system 120.
Figure 4B:
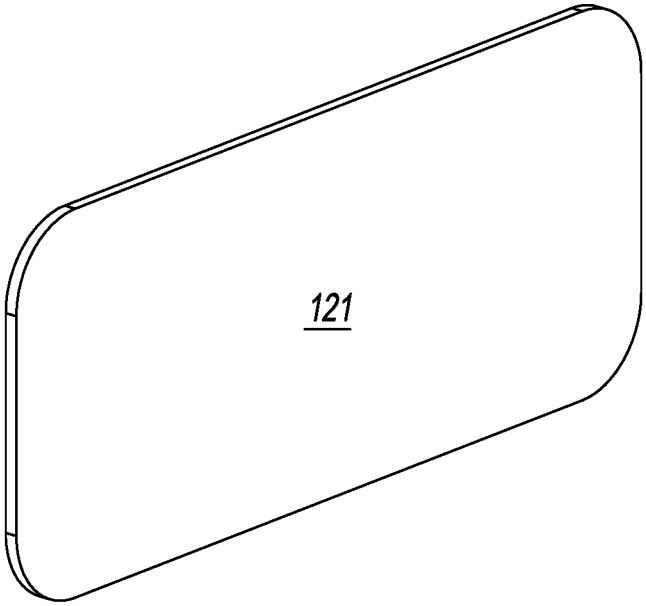

As best shown in FIGS. 4A-4B, the guard plate 121 may comprise a substantially rectangular shape, optionally having rounded corners to facilitate attachment to the holster 110. In one embodiment, the guard plate 121 may comprise a length of from about 1.5 inches to about 3.5 inches (e.g., about 1.5 inches, about 2 inches, about 2.5 inches, about 3 inches, or about 3.5 inches). The guard plate may further comprise a width of from about 1 inch to about 2 inches (e.g., about 1 inch, about 1.5 inches, or about 2 inches). It will be appreciated that, although the guard plate 121 is illustrated as being substantially rectangular in shape, the guard plate may comprise nearly any shape as long as it covers the trigger 152 of a holstered handgun 150.

In certain embodiments, the guard plate 121 may generally comprise a thickness of from about 0.02 inches to about 0.06 inches (e.g., about 0.02 inches, about 0.03 inches, about 0.04 inches, about 0.05 inches or about 0.06 inches). It will be appreciated that the thickness of the guard plate 121 may vary based on the material employed.

The cover 122 of the trigger guard 120 is adapted to cover at least the front and side surfaces of the guard plate 121, while facilitating attachment of the guard plate to the front panel 113 of the holster 110. The cover 122 may comprise closed front, top, bottom, left and right sides that define a hollow interior space sized to receive the guard plate 121. In one embodiment, the rear surface of the cover 122 may be closed such that the guard plate 121 can be entirely housed within the hollow interior space of the cover. In another embodiment, the rear surface of the cover 122 may be open. It will be appreciated that, in both cases, the guard plate 121 will remain securely seated within the interior space of the cover 122, as the rear surface of the cover will be closed when it is attached to the front panel 113 of the holster 110.

The cover 122 may generally comprise any material capable of covering the guard plate and attaching to the holster. In one embodiment, a leather or faux leather material may be employed. Exemplary faux leather materials include, but are not limited to, polyvinyl chloride ("PVC") faux leather and polyurethane ("PU") faux leather.

In order to house the guard plate and attach to the holster, the cover 122 may comprise a length, width and thickness that are slightly greater than those of the guard plate 121. Generally, the cover 121 may be attached to the holster 110 via stitching, bonding, an adhesive or other attachment means. Moreover, as discussed below, the cover may comprise a fastener 125 adapted to mate with a complementary fastener of a securing strap.

Securing Strap

As shown in FIGS. 1A-3, in one embodiment, the handgun holster device 100 may include a securing strap 130 that allows a user to open and close the top aperture 111 of the holster 110. Generally, the securing strap 130 may extend from a first end 131 that is attached to the holster (e.g., to a rear panel 105) to a second end 132 that may be removably fastened to the holster (e.g., to a front panel 113 or the cover 122 of the trigger guard 120). The securing strap 130 may be placed in a closed position to securely retain a handgun 150 disposed within the holster 110 by extending the strap around a grip portion 151 of the gun 150 and fastening the second end 132 to the holster. And the securing strap 130 may be placed in an open position such that a handgun 150 may be inserted into, or removed from, the holster 110, via the top aperture 111, by unfastening the second end 132 from the holster.

FIG. 1A shows the securing strap 130 in a closed position. The strap 130 extends from a first end 131 fixed to the rear panel 105 of the holster (e.g., via stitching or the like), around the grip 151 of a handgun 150 seated within the holster 110, to a second end 132 removably fastened to the trigger guard cover 122. The second end 132 may be removably fastened to the cover 122 of the trigger guard via a fastener 135 located on or near the second end 132 and a complementary fastener 125 located on the trigger guard cover 122. Exemplary fasteners include, but are not limited to, snaps, hook and loop fasteners, buttons, clips and others.

FIG. 3 shows the securing strap 130 in an open position, wherein the second end 132 of the strap is not attached to the holster 110. As shown, the top aperture 111 of the holster is open; therefore, a handgun may be inserted into, or removed from, the holster 110 via the top aperture 111.

Figure 5A:
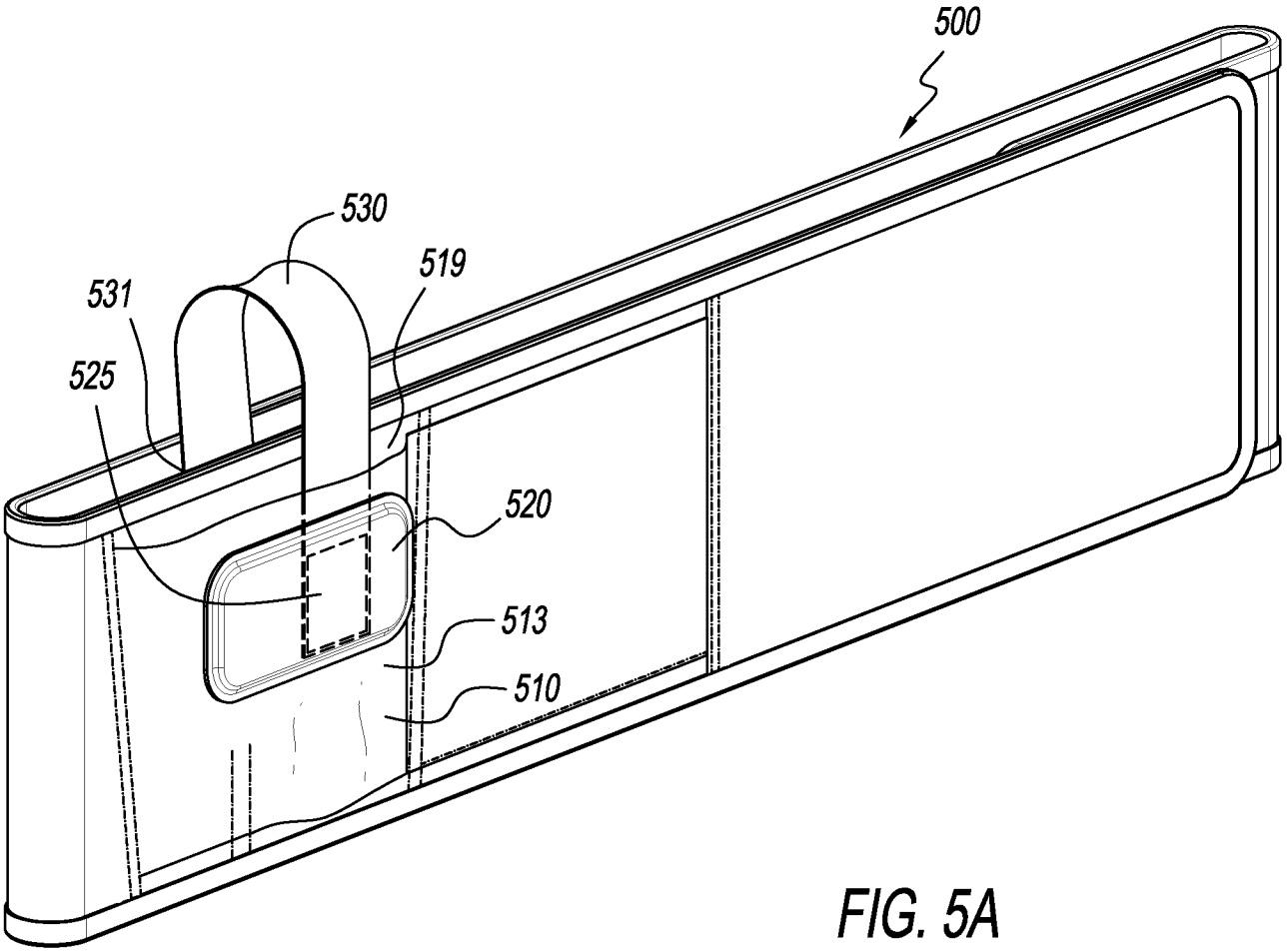
FIGS. 5A-5B show an exemplary handgun holster device 500 in closed and open configurations, respectively, wherein a securing strap 530 may be removably fastened to an inner surface of a front panel 513 of the holster 510 via complementary fasteners 525, 535.
Figure 5B:
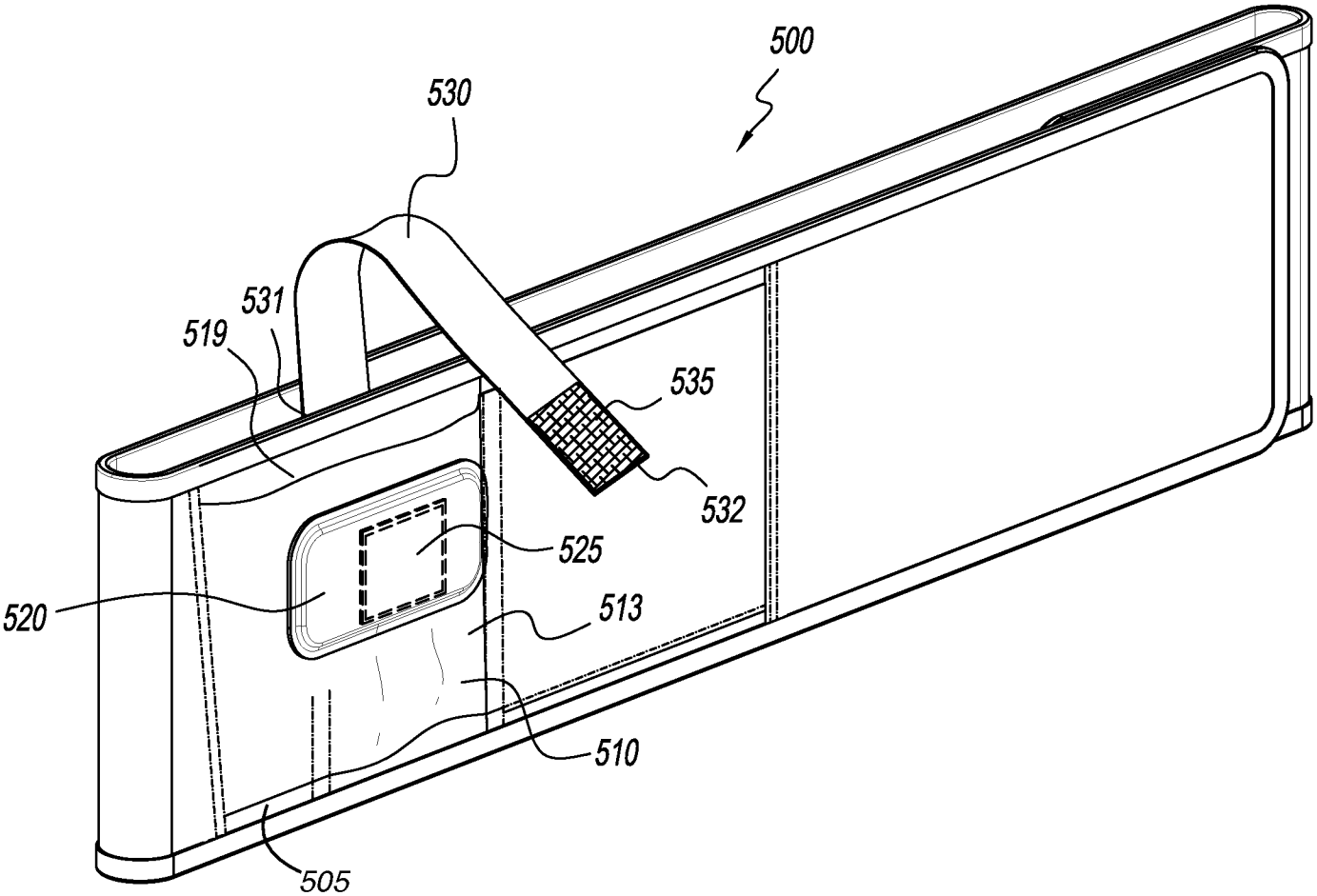

Referring to FIGS. 5A-5B, a handgun holster device 500 substantially similar to the device 100 shown in FIGS. 1A-3 is illustrated with an alternative embodiment of the securing strap 530. FIG. 5A shows the securing strap 530 in a closed position and FIG. 5B shows the securing strap in an open position.

As shown, the securing strap 530 may extend from a first end 531 fixed to a rear panel 505 of the holster 510 to a second end 532 that is removably fastenable to an inner surface of a front panel 513 of the holster (i.e., within an interior compartment 519 of the holster). Unlike the previous embodiment, the securing strap 530 does not fasten to the trigger guard 520. Rather, the second end 532 of the securing strap 530 comprises a fastener 535 and the inner surface of the front panel 513 comprises a complementary fastener 525. Accordingly, the securing strap 530 may be placed into a closed position by extending the strap around the grip of a handgun disposed within the interior compartment 519 of the holster 510 and fastening the second end 532 of the strap to the inner surface of the front panel 513 via the respective fasteners 535, 525. In one particular embodiment, hook and loop fasteners may be employed to facilitate quick opening and closing.

It will be appreciated that, in both of the above embodiments, the securing strap 130, 530 may comprise any size, shape and/or material capable of being wrapped around a grip portion of a handgun and exerting a suitable downward force to prevent the gun from exiting the holster through the top aperture. For example, the securing strap may comprise an elastic material having a length of from about 1 inch to about 4 inches and width of from about 0.5 inches to about 2 inches.

Support Band

In one embodiment, the holster device 100 may comprise a support band 101 adapted to support the holster 110 and to be worn on a part of a user's body (e.g., a waist, chest, arm, shoulder, ankle, etc.). The support band 101 may be made of a soft, flexible material, such as but not limited to: elastic, neoprene, suede leather, cotton, polyester, rubber, nylon and/or combinations thereof. The support band may comprise the same material as the front panel 113 of the holster, or may comprise a different material. In one particular embodiment, the front panel 113 comprises a woven elastic material and the support band 101 comprises a neoprene material.

As shown, the support band 101 may extend from a first end 102 to a second end 103. The support band may be wrapped about a body part of the user and the two ends 102, 103 may be securely fastened together via a fastening mechanism, such as but not limited to: hook and loop fasteners, snaps, zippers, buttons, clips, etc.

In one embodiment, the support band 101 may be integral with the holster 110. For example, a portion of the support band 101 located between the first end 102 and the second end 103 may be employed as the rear panel 105 of the holster. That is, a front surface of the support band may be joined to the rear surface of the front panel to form the holster, as discussed above.

In other embodiments, the holster 110 may include an attachment means for releasably attaching the holster 110 to a support band 101 or another device for supporting the holster (e.g., a belt). In such cases, the attachment means may comprise a clip, snap, loop, or hook provided on a rear surface of the rear panel 105 of the holster 110, such that the holster may be, for example, attached to the support band 101 or a belt. Alternatively, the attachment means may comprise one or more quick-disconnect or other couplings provided on, or adjacent to, left 116 and right 117 sides of the of the holster 110 to allow the holster to be removably attached to corresponding and cooperating coupling(s) provided on a support band 101, belt, carrier, platform, device, or other object.

It will be appreciated that, although a single holster 110 is shown to be attached to the support band 101, alternative embodiments may comprise a plurality of holsters attached or integrated into a single support band. Additionally or alternatively, the support band 101 may comprise any number of pockets 140 configured to hold various accessories (e.g., ammunition magazines, flashlights, smartphones, headphones, etc.).

Various embodiments are described in this specification, with reference to the detailed discussed above, the accompanying drawings, and the claims. Numerous specific details are described to provide a thorough understanding of various embodiments. However, in certain instances, well-known or conventional details are not described in order to provide a concise discussion. The figures are not necessarily to scale, and some features may be exaggerated or minimized to show details of particular components. Therefore, specific structural and functional details disclosed herein are not to be interpreted as limiting, but merely as a basis for the claims and as a representative basis for teaching one skilled in the art to variously employ the embodiments. In this regard, directional terminology, such as "vertical," "horizontal," "top," "bottom," "front," "back," "left," "right," etc., is used with reference to the orientation of the drawing (s) being described. Because components of the embodiments can be positioned in a number of different orientations, the directional terminology is used for purposes of illustration and is in no way limiting.

The embodiments described and claimed herein and drawings are illustrative and are not to be construed as limiting the embodiments. The subject matter of this specification is not to be limited in scope by the specific examples, as these examples are intended as illustrations of several aspects of the embodiments. Any equivalent examples are intended to be within the scope of the specification. Indeed, various modifications of the disclosed embodiments in addition to those shown and described herein will become apparent to those skilled in the art, and such modifications are also intended to fall within the scope of the appended claims.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

All references including patents, patent applications and publications cited herein are incorporated herein by reference in their entirety and for all purposes to the same extent as if each individual publication or patent or patent application was specifically and individually indicated to be incorporated by reference in its entirety for all purposes.

What is claimed is:

1. A handgun holster device comprising:

a holster having a front panel joined to a rear panel to define an interior compartment configured to receive a handgun, the holster comprising:

closed left and right sides;

a top surface extending between the closed left and right sides, the top surface comprising a top aperture in communication with the interior compartment and configured to allow the handgun to be inserted into, and removed from, the interior compartment;

a bottom surface extending parallel to the top surface, between the closed left and right sides, the bottom surface comprising a bottom aperture in communication with the interior compartment and configured to allow a barrel of the handgun to extend out of the interior compartment;

a trigger guard configured to prevent a trigger of the handgun from being actuated, the trigger guard comprising:

a cover attached to a front surface of the front panel; and a guard plate disposed within the cover, and a central wall formed by joining the front panel to the rear panel, the central wall extending into the interior compartment and configured to contact a trigger protector portion of the handgun to thereby prevent further downward movement of the handgun; and wherein the front panel and the rear panel are each made of a flexible material selected from the group consisting of: elastic, neoprene, suede leather, cotton, polyester, rubber, nylon and combinations thereof.

2. A handgun holster device according to claim 1, wherein the guard plate comprises a rigid material selected from the group consisting of: plastic and metal.

3. A handgun holster device according to claim 1, wherein the guard plate comprises a substantially rectangular shape and a thickness of from about 0.02 inches to about 0.06 inches.

4. A handgun holster device according to claim 1, wherein the cover of the trigger guard comprises a material selected from the group consisting of: leather and faux leather.

5. A handgun holster device according to claim 1, wherein:

the front panel is joined to the rear panel via stitching or an adhesive; and the cover of the trigger guard is attached to the front surface of the front panel via stitching or an adhesive.

6. A handgun holster device according to claim 1, further comprising a securing strap configured to allow a user to:

open the top aperture to insert or remove the handgun from the interior compartment; and close the top aperture to prevent the handgun from exiting the interior compartment.

7. A handgun holster device according to claim 6, wherein the securing strap comprises:

a first end attached to a rear surface of the rear panel; and a second end comprising a fastener.

8. A handgun holster device according to claim 7, wherein the cover of the trigger guard comprises a complementary fastener adapted to be removably fastened to the securing strap fastener.

9. A handgun holster device according to claim 7, wherein a rear surface of the front panel comprises a complementary fastener adapted to be removably fastened to the securing strap fastener.

10. A handgun holster device according to claim 9, wherein the fastener and complementary fastener are hook-and-loop fasteners.

11. A handgun holster device according to claim claim 1, wherein:

the central wall extends vertically between a bottom located at the bottom surface of the holster to a top located within the interior compartment; and the bottom aperture extends along the bottom surface, from the bottom of the central wall to about the closed right side of the holster.

12. A handgun holster device according to claim claim 1, wherein the trigger guard extends along the front surface of the front panel, above the central wall.

13. A handgun holster device according to claim 1, wherein:

the front panel comprises elastic; and the rear panel comprises neoprene.

14. A handgun holster device according to claim 1, wherein a rear surface of the rear panel comprises an attachment means for removably attaching the holster to a garment or a support band.

15. A handgun holster device according to claim 1, further comprising a support band adapted to support the holster and to be worn on a body part of a user.

16. A handgun holster device according to claim 15, wherein the support band is integral with the holster such that the rear surface of the holster is formed by a front surface of the support band.

17. A handgun holster device according to claim 16, wherein:

the support band is configured to be worn around a waist of the user; and the support band comprises one or more pockets.

18. A handgun holster device according to claim 16, wherein:

the front panel of the holster comprises elastic; and the support band comprises neoprene.

19. A handgun holster device according to claim 15, wherein the holster is removably attached to the support band.

20. A handgun holster device according to claim 1, wherein the central wall is positioned between and spaced apart from the left and right sides of the holster.

* * * * *